US009437980B2

(12) United States Patent
Ueda et al.

(10) Patent No.: US 9,437,980 B2
(45) Date of Patent: Sep. 6, 2016

(54) CONNECTOR

(71) Applicant: Japan Aviation Electronics Industry, Limited, Tokyo (JP)

(72) Inventors: Kouhei Ueda, Tokyo (JP); Masaaki Takaku, Tokyo (JP); Yohei Yokoyama, Tokyo (JP); Kentaro Toda, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/717,313

(22) Filed: May 20, 2015

(65) Prior Publication Data

US 2016/0013599 A1 Jan. 14, 2016

(30) Foreign Application Priority Data

Jul. 8, 2014 (JP) ..... 2014-140718

(51) Int. Cl.
*H01R 13/648* (2006.01)
*H01R 13/6596* (2011.01)
*H01R 12/72* (2011.01)

(52) U.S. Cl.
CPC ..... *H01R 13/6596* (2013.01); *H01R 12/724* (2013.01)

(58) Field of Classification Search
CPC ..... H01R 12/7052; H01R 13/6594; H01R 12/707; H01R 23/6873
See application file for complete search history.

(56) References Cited

U.S. PATENT DOCUMENTS 7,670,156 B2 * 3/2010 Chen ..... H01R 13/6485 439/108
7,758,379 B2 * 7/2010 Chen ..... H01R 13/6485 439/607.11
8,968,031 B2 * 3/2015 Simmel et al. ..... H01R 13/659 439/108
9,281,626 B2 * 3/2016 Lin ..... H01R 13/6581
9,331,433 B2 * 5/2016 Ueda ..... H01R 13/6581

FOREIGN PATENT DOCUMENTS

JP 2008-041656 A 2/2008

* cited by examiner

*Primary Examiner* — Xuong Chung Trans
(74) *Attorney, Agent, or Firm* — Muncy, Geissler, Olds & Lowe, P.C.

(57) ABSTRACT

A connector includes a plurality of signal contacts and a plurality of non-signal contacts arranged on at least one contact array plane, a ground plate disposed on a ground plane parallel to the contact array plane so as to face the plurality of signal contacts and the plurality of non-signal contacts, and an insulator which holds the plurality of signal contacts, the plurality of non-signal contacts and the ground plate, at least one of the non-signal contacts being disposed between each of the signal contacts and other of the signal contacts, the ground plate having at least one opening at a location facing the at least one of the non-signal contacts disposed between each of the signal contacts and other of the signal contacts, none of the signal contacts being disposed on the ground plane.

16 Claims, 9 Drawing Sheets

CONNECTOR

BACKGROUND OF THE INVENTION

The present invention relates to a connector, and more particularly, to a connector having signal contacts that transmit/receive signals to/from a counter connector, and non-signal contacts adapted for non-signal purposes such as power supply, and ground connection.

In general, in a connector adapted to transmit/receive signals and power supply to/from external apparatuses, a plurality of contacts including signal contacts for signal transmission, and non-signal contacts to be used for non-signal purposes such as power supply and ground connection, are arranged in one or more arrays. In such cases, in order to suppress cross-talk in signals transmitted at high-speed through the signal contacts, an arranging scheme is employed, for example, in which a non-signal contact is inserted between one signal contact and other signal contact so that the space between the signal contacts can be widened.

However, in recent years, with a decrease in size and an increase in density of electronic devices such as portable devices and information devices, connectors are also required to reduce in size and thus the space between two adjacent contacts in a connector is decreased as well. Therefore it becomes difficult to satisfactorily suppress cross-talk, only by widening the space between the signal contacts in a certain limited range.

For example, JP 2008-41656 A discloses a connector in which contacts are arranged in two rows of an upper row and a lower row. As shown in FIG. 28, in the lower row, a ground contact 2 is disposed adjacent to two signal contacts 1 that constitute a differential signal contact pair, and as shown in FIG. 29, a ground plate 4 extending in a connector fitting direction is disposed between the signal contacts 1 and the ground contact 2 in the lower row and signal contacts 3 in the upper row. In this way, the circumference of the differential signal contact pair is encompassed by the ground contact 2 and the ground plate 4 so as to improve cross-talk suppression.

However, for example, in a connector in which the contact arranging pitch is reduced to about 0.5 mm or less, and a high speed transmission of 5 Gbps (gigabits per second) or more is enabled, there is a problem in which cross-talk is not satisfactorily suppressed even if the circumference of signal contacts is encompassed by a ground contact and a ground plate.

SUMMARY OF THE INVENTION

The present invention is made to solve the above-mentioned problems in the prior art and an object thereof is to provide a connector capable of suppressing the occurrence of cross-talk, while achieving a decrease in size and high speed transmission.

The inventors of the present invention have conducted intensive studies and have found that in a connector which is small in size and performs high speed signal transmission, when a ground contact or a power supply contact is disposed between a pair of signal contacts, and a ground plate extending in a connector fitting direction is disposed parallel to these contacts, cross-talk occurs between contacts, in a portion of the pair of signal contacts for high speed transmission, extending in the connector fitting direction, through the ground plate disposed parallel thereto.

Therefore, a connector according to the present invention comprises a plurality of signal contacts and a plurality of non-signal contacts arranged on at least one contact array plane, a ground plate disposed on a ground plane parallel to the contact array plane so as to face the plurality of signal contacts and the plurality of non-signal contacts, and an insulator which holds the plurality of signal contacts, the plurality of non-signal contacts and the ground plate, wherein at least one of the non-signal contacts is disposed between each of the signal contacts and other of the signal contacts, wherein the ground plate has at least one opening at a location facing the at least one of the non-signal contacts disposed between each of the signal contacts and other of the signal contacts, and wherein none of the signal contacts are disposed on the ground plane.

DETAILED DESCRIPTION OF THE INVENTION

Hereinafter, embodiments of the present invention will be described with reference to the accompanying drawings.

Embodiment 1

Figure 1:
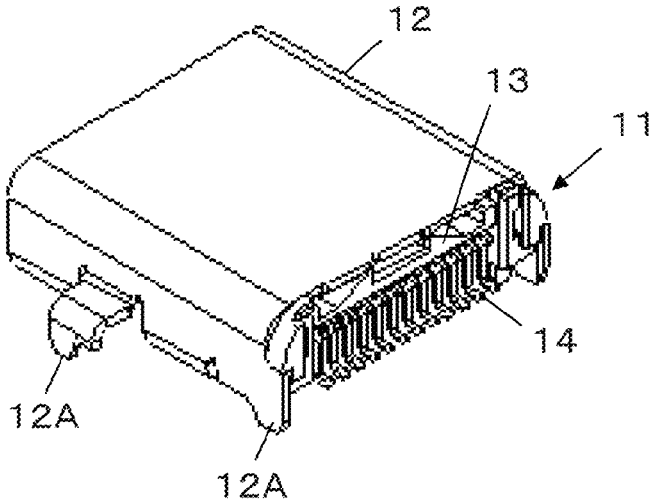
FIGS. 1 and 2 are a perspective view and a front view, illustrating a connector according to Embodiment 1 of the present invention, respectively.

FIG. 1 shows a connector 11 according to Embodiment 1. The connector 11 is a receptacle connector to be fixed to a substrate in electronic devices such as portable devices and information devices. The connector 11 has a metal shell 12, an insulator 13 disposed inside the metal shell 12, and contacts 14 held by the insulator 13.

The metal shell 12 covers an outer periphery portion of the insulator 13, excluding a front surface section and a back surface section of the insulator 13, facing the fitting direction of the connector 11. Shell leg sections 12A to be mounted to the substrate are formed protrudingly in a direction perpendicular to the fitting direction of the connector 11.

Figure 2:
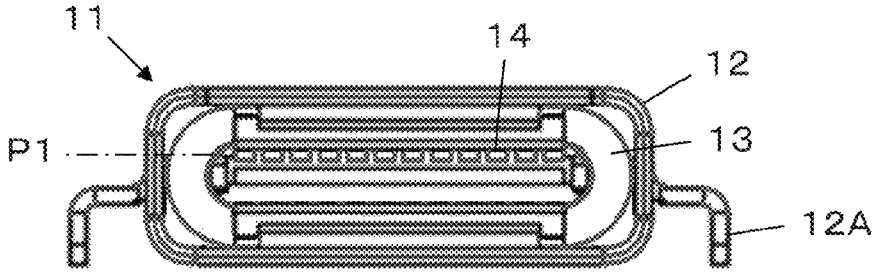
Figure 3:
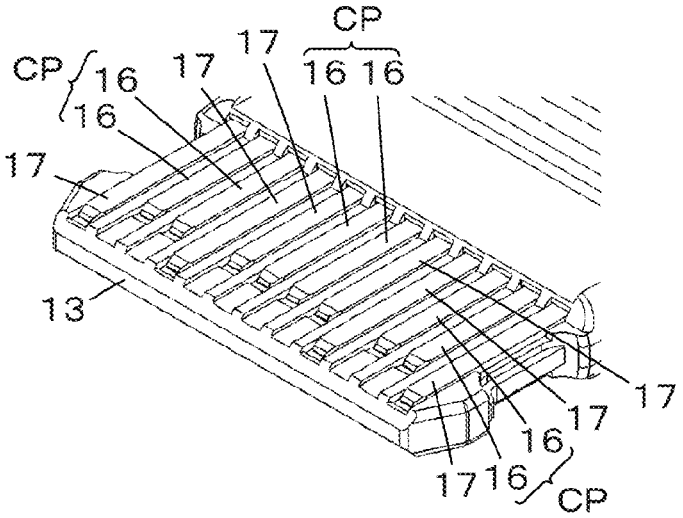
FIG. 3 is a partial perspective view, illustrating contacts held by an insulator in the connector according to Embodiment 1.

As shown in FIG. 2, contacts 14 are held by the insulator 13, with the contacts 14 being arranged in a line on a contact array plane P1. These contacts 14 consist of signal contacts 16 configured to transmit and receive signals to and from a counter connector, and non-signal contacts 17 to be used for non-signal purposes, as shown in FIG. 3. The non-signal contacts 17 include, for example, a power supply contact, a ground contact, and a contact for detecting connector fitting status. Three sets of differential signal contact pairs CPs, each consisting of two signal contacts 16 adjacent to each other, are formed and two non-signal contacts 17 are disposed between each differential signal contact pair CP and other differential signal contact pair CP.

Figure 4:
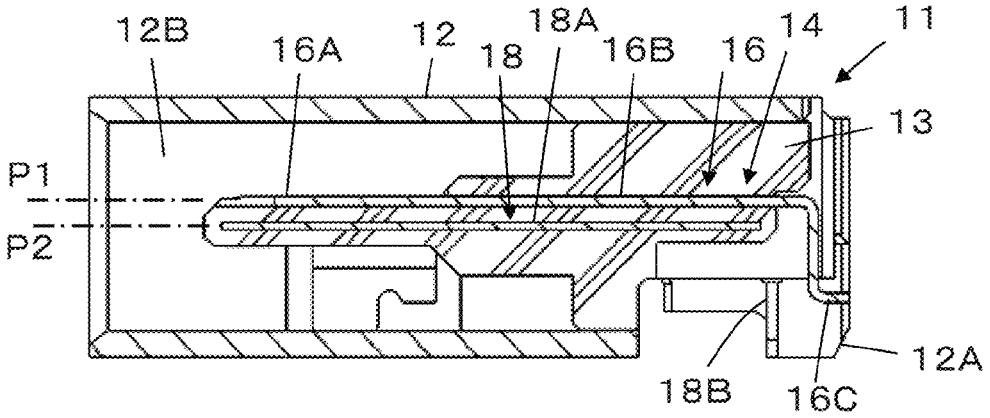
FIG. 4 is a cross-sectional view of the connector according to Embodiment 1, taken by cutting at a location of the signal contacts.

FIG. 4 shows a cross-sectional view of the connector 11, taken by cutting at a location of one of the signal contacts 16. Inside the front end of the metal shell 12, a counter connector housing section 12B to which a counter connector is inserted is formed. Inside the back end of the metal shell 12, the insulator 13 is housed.

Each of the signal contacts 16 has a contact section 16A at its front end exposing to the counter connector housing section 12B, an insulator fixing section 16B in its middle portion embedded and fixed in the insulator 13, and a substrate mounting section 16C at its back end to be mounted and fixed to a substrate. The contact section 16A is to be in contact with a contact of a counter connector inserted in the counter connector housing section 12B. The contact section 16A and the insulator fixing section 16B are extended flatly on the contact array plane P1. The substrate mounting section 16C to be connected to the insulator fixing section 16B protrudes to a back section of the insulator 13, and has a shape bending with respect to the insulator fixing section 16B.

In addition, in the insulator 13, a ground plate 18 is held. The ground plate 18 is formed of a metal plate extending along a ground plane P2 parallel to the contact array plane P1 on which the contacts 14 including the signal contacts 16 are arranged. The ground plate 18 has a plate body 18A embedded in the insulator 13, and a plate leg section 18B exposed to outside from the back end of the insulator 13. The plate body 18A extends along the ground plane P2. The plate leg section 18B, together with the shell leg section 12A of the metal shell 12 protrudes in a direction perpendicular to the contact array plane P1 and the ground plane P2.

Figure 5:
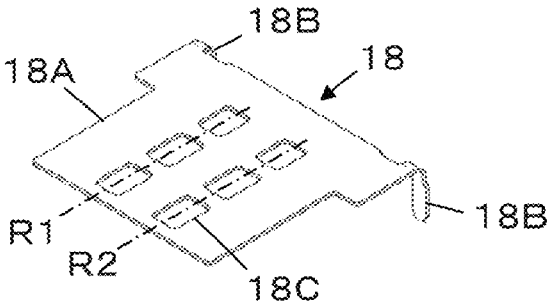
FIGS. 5 and 6 are a perspective view and a plan view, illustrating a ground plate used in the connector according to Embodiment 1, respectively.
Figure 6:
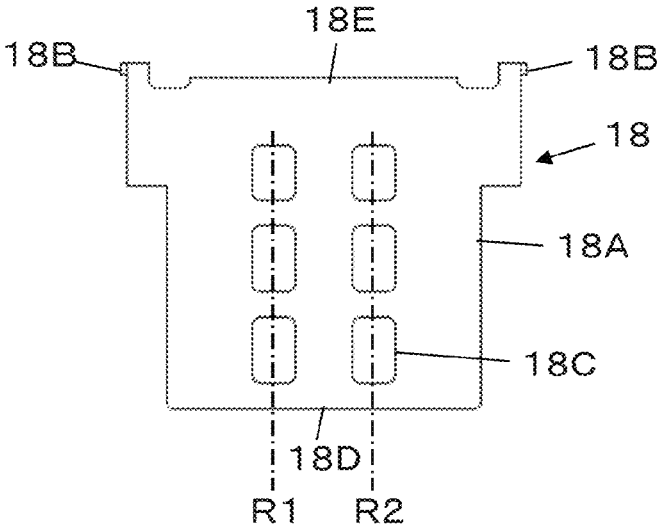

As shown in FIG. 5, in the plate body 18A of the ground plate 18, openings 18C are formed. The openings 18C are arranged in two rows R1 and R2 parallel to each other. The plate body 18A has, as shown in FIG. 6, a plate front end section 18D and a plate back end section 18E, and each of the rows R1 and R2 has three openings 18C disposed between the plate front end section 18D and the plate back end section 18E.

Figure 7:
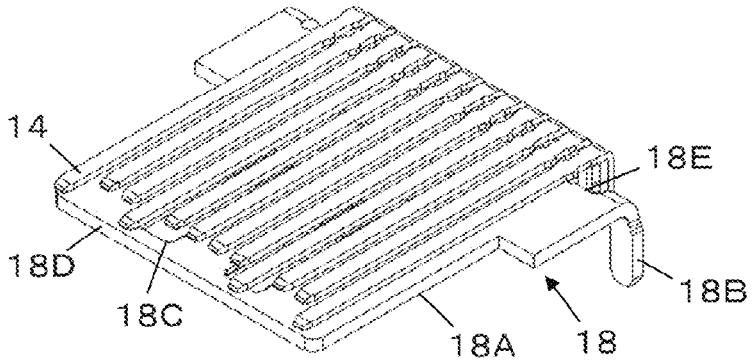
FIGS. 7 and 8 are a perspective view and a plan view, illustrating the contacts and the ground plate in the connector according to Embodiment 1, respectively.
Figure 8:
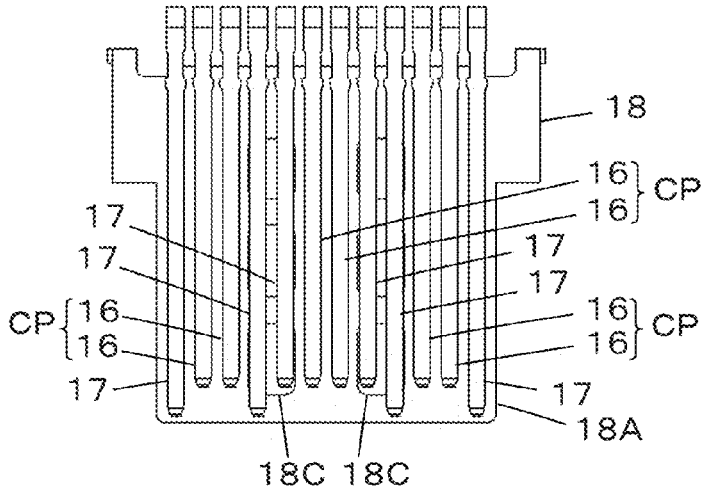

As shown in FIG. 7, the ground plate 18 described above is disposed adjacent to the contacts 14. The openings 18C are formed facing two non-signal contacts 17 disposed between each differential signal contact pair CP and other differential signal contact pair CP, as shown in FIG. 8. That is, the plate body 18A of the ground plate 18 is disposed facing all of the contacts 14 arranged on the contact array plane P1, and in a portion facing each of the signal contacts 16, none of the openings 18C are formed, while three openings 18C are formed in a portion facing the two non-signal contacts 17 disposed between the signal contacts 16 that constitute each differential signal contact pair CP and the signal contacts 16 that constitute other differential signal contact pair CP.

Figure 9:
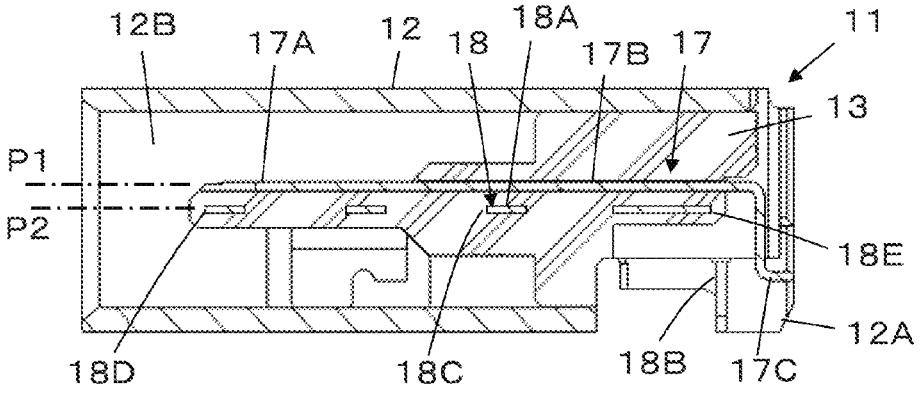
FIG. 9 is a cross-sectional view of the connector according to Embodiment 1, taken by cutting at a location of non-signal contacts.

Accordingly, if the connector 11 is cut at a location of the non-signal contacts 17 disposed among the three sets of differential signal contact pairs CPs, as shown in FIG. 9, the ground plate 18 is separated by three openings 18C.

Each of the non-signal contacts 17 is configured similarly signal contacts 16, and has, at a front end, a contact section 17A protruding to the counter connector housing section 12B, has, in a middle portion, an insulator fixing section 17B to be fixed and embedded in the insulator 13, and has, at a back end, a substrate mounting section 17C to be mounted and fixed to a substrate. The contact section 17A is to be in contact with the contact of a counter connector inserted in the counter connector housing section 12B, and the contact section 17A and the insulator fixing section 17B are extended flatly on the contact array plane P1. The substrate mounting section 17C connected to the insulator fixing section 17B protrudes to the back section of the insulator 13, and has a shape bending with respect to the insulator fixing section 17B.

In addition, the plate front end section 18D of the ground plate 18 faces the front end of the contact section 17A of the non-signal contact 17, and the plate back end section 18E faces the back end of the insulator fixing section 17B of the non-signal contact 17 at the side of the substrate mounting section 17C.

Accordingly, the contact sections 16A and the insulator fixing sections 16B of the signal contacts 16, and the contact sections 17A and the insulator fixing sections 17B of the non-signal contacts 17 extend on the contact array plane P1. The plate body 18A of the ground plate 18 extending along the ground plane P2 parallel to the contact array plane P1 faces the contact sections 16A and the insulator fixing sections 16B of the signal contacts 16, and the contact sections 17A and the insulator fixing sections 17B of the non-signal contacts 17. In the plate body 18A of the ground plate 18, the openings 18C are formed in a portion facing the two non-signal contacts 17 disposed between each differential signal contact pair CP and other differential signal contact pair CP. Such a connector 11 can be manufactured by insert-molding the signal contacts 16, the non-signal contacts 17, and the ground plate 18 with a resin that forms the insulator 13, so that the insulator fixing sections 16B of the signal contacts 16, the insulator fixing section 17B of the non-signal contacts 17, and the plate body 18A of the ground plate 18 are embedded in the insulator 13, followed by press-fitting the insulator 13 into the metal shell 12.

Figure 10:
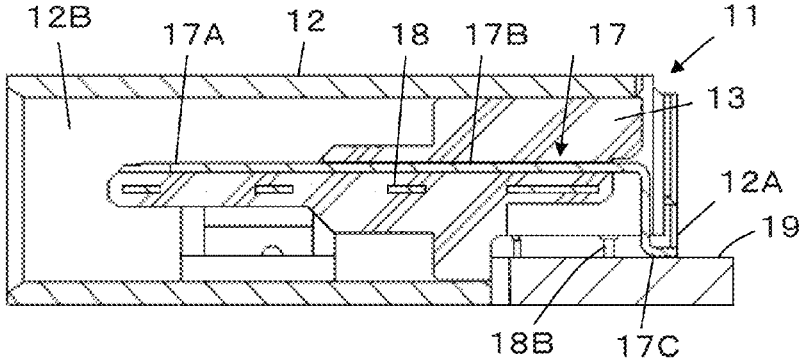
FIG. 10 is a cross-sectional view illustrating the connector according to Embodiment 1, as mounted on a substrate.

The connector 11 is used as mounted on a substrate 19, as shown in FIG. 10. The shell leg section 12A of the metal shell 12, and the plate leg section 18B of the ground plate 18 are inserted in a through-hole (not shown) formed in the substrate 19, and mounted and fixed by soldering, so that the connector 11 is mounted on the substrate 19, and the metal shell 12 and the ground plate 18 are connected to a ground potential via the through-hole in the substrate 19. In addition, the substrate mounting sections 16C of the signal contacts 16, and the substrate mounting sections 17C of the non-signal contacts 17 are mounted and fixed to each corresponding connecting pad (not shown) on the substrate 19 by soldering, and then connected to, for example, a not shown electronic circuit mounted on the substrate 19.

A not shown counter connector is inserted into the counter connector housing section 12B of the metal shell 12, and the contact sections 16A of the signal contacts 16, and the contact sections 17A of the non-signal contacts 17 are made in contact with each corresponding contact of the counter connector, so that the connector is set into a fitting status, thereby enabling transmitting and receiving signals to and from external apparatuses.

Figure 11:
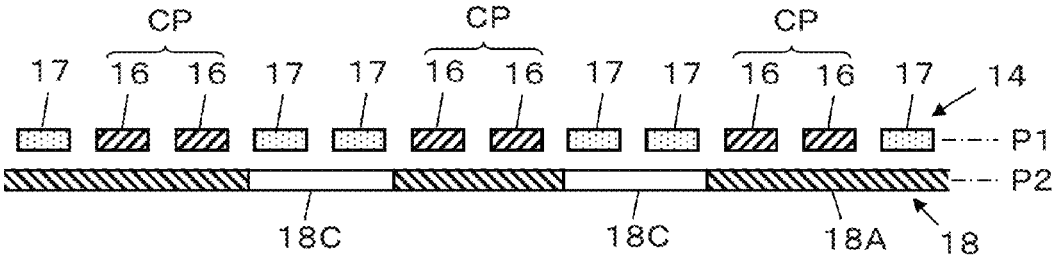
FIG. 11 is a partial front cross-sectional view, showing a positional relationship between the contacts and the ground plate in the connector according to Embodiment 1.

At this time, as shown in FIG. 11, each differential signal contact pair CP consisting of two adjacent signal contacts 16 is encompassed by the non-signal contacts 17 disposed on the both sides of the contact array plane P1, and the plate body 18A of the ground plate 18 disposed on the ground plane P2, so that the occurrence of cross-talk between each differential signal contact pair CP and other differential signal contact pair CP can be suppressed.

Further, two non-signal contacts 17 are disposed between each differential signal contact pair CP and other differential signal contact pair CP, and the openings 18C are formed in the plate body 18A in a portion facing the two non-signal contacts 17. Thus, for example, while the arranging pitch of the contact is reduced to about 0.5 mm or less, and high speed transmission of 5 Gbps (gigabits per second) or more is achieved, the occurrence of cross-talk between each differential signal contact pair CP and other differential signal contact pair CP through the ground plate 18 can be prevented.

As a result, a connector capable of high speed signal transmission with a high degree of accuracy, while the size of the connector is reduced, is realized.

Figure 12A:
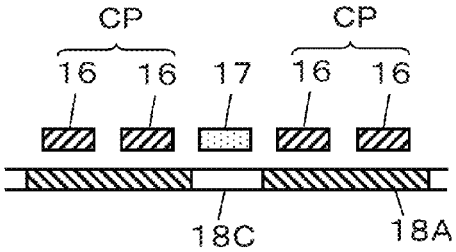
FIGS. 12A and 12B are partial front cross-sectional views each illustrating a positional relationship between contacts and a ground plate of a connector according to a variation example and other variation of Embodiment 1.

It should be noted that while in Embodiment 1 described above, two non-signal contacts 17 are disposed between each differential signal contact pair CP and other differential signal contact pair CP, the present invention is not limited to this. As shown in FIG. 12A one non-signal contact 17 may be disposed between each differential signal contact pair CP and other differential signal contact pair CP, so as to suppress cross-talk. In this regard, however, in order to suppress cross-talk more effectively, it is more preferable to dispose two or more non-signal contacts 17 between each differential signal contact pair CP and other differential signal contact pair CP to widen the space therebetween. In addition, three or more non-signal contacts 17 may be disposed between each differential signal contact pair CP and other differential signal contact pair CP.

Figure 12B:
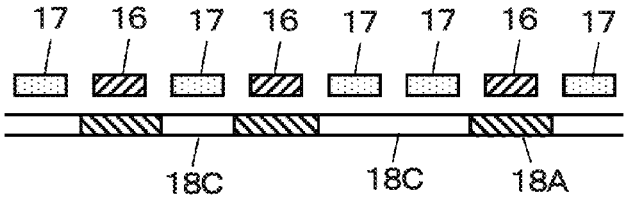

Further, it is not limited to use the signal contacts 16 constituting the differential signal contact pair CP, but as shown in FIG. 12B, one signal contact 16 may be used. One or more non-signal contacts 17 may be disposed between one signal contact 16 and other signal contact 16, and the openings 18C may be formed on the plate body 18A of the ground plate 18 at a portion facing the non-signal contacts 17, thereby the occurrence of cross-talk can be suppressed and high speed signal transmission via the signal contacts 16 can be achieved.

Further, while in Embodiment 1 described above, the plate body 18A of the ground plate 18 has three openings 18C between the plate front end section 18D and the plate back end section 18E, the number of openings 18C is not limited to three, and the plate body 18A of the ground plate 18 may have two or four or more openings 18C.

Embodiment 2

While, in the around plate 18 used in Embodiment 1 described above, as shown in FIG. 6, the openings 18C are formed in the two rows R1 and R2 parallel to each other, and each of the rows R1 and R2 has three openings 18C between the plate front end section 18D and the plate back end section 18E, the present invention is not limited to this.

Figure 13A:
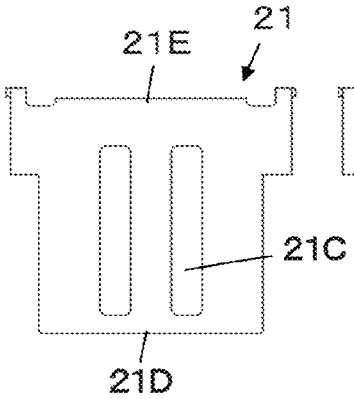
FIGS. 13A to 13C are plan views of ground plates used in a connector according to Embodiment 2.

For example, as shown in FIG. 13A, a ground plate 21 having a single opening 21C that extends from a plate front end section 21D to a plate back end section 21E, corresponding to the non-signal contact 17, instead of having plural openings 21C between the plate front end section 21D and the plate back end section 21E, may be used.

Figure 13B:
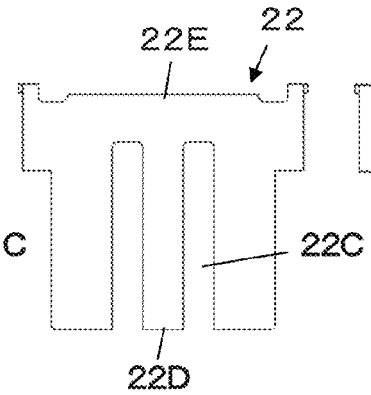

Also, as in a ground plate 22 shown in FIG. 13B, the plate front end section 22D may be notched to provide an opening 22C with the front end being opened.

Figure 13C:
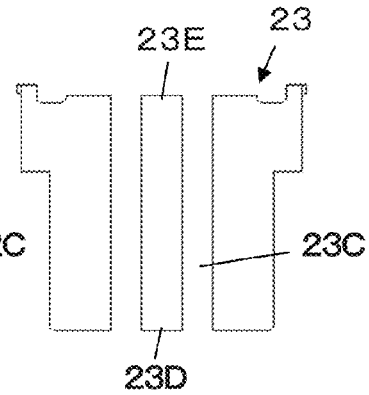

Further, as in a ground plate 23 shown in FIG. 13C, a plate front end section 23D and a plate back end section 23E may be both notched to provide an opening 23C with both front and back ends being opened.

Figure 14:
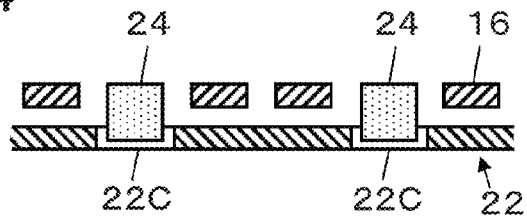
FIG. 14 is a partial front cross-sectional view illustrating a positional relationship between the contacts and the ground plate in the connector according to Embodiment 2.

If the front end of the opening 22C is opened, as in the ground plate 22, a power supply contact 24 that is formed to be thicker than the signal contacts 16, for example, as shown in FIG. 14, can be disposed corresponding to the opening 22C and used as one of the non-signal contacts 17. The presence of the opening 22C can prevent short-circuiting between the power supply contact 24 and the ground plate 22 even if the surface heights of the contact section 16A of the signal contacts 16 and the contact section 17A of the non-signal contacts 17 exposed outside of the insulator 13 are aligned. Thereby, it is possible to increase the cross area of the power supply contact 24 to increase the current capacity.

Similarly, by using the ground plate 23 having the opening 23C with the both front and back ends being opened, it is also possible to easily increase the cross area of the power supply contact 24 to increase the current capacity.

It should be noted that, in case a ground plate in which no openings are formed is disposed adjacent to contacts, as in a prior art connector, when a certain contact is formed to be thick, in order to align the surface height of the contacts exposing outside of an insulator, the facing surface of the contacts comes close to the ground plate depending on the thickness, causing a potential short-circuiting. Therefore, it has been difficult to increase the current capacity by having a thicker power supply contact.

In this regard however, when insert-molding the ground plates 18 and 21-23 together with a resin used for forming the insulator 13, the ground plates 18 and 21-23 are required to have a certain necessary strength to prevent displacement or deformation against the injection pressure of the resin. Therefore, in terms of strength, the ground plates 18 and 21 in which the front ends of the openings 18C and 21C are closed are advantageous. In particular, since the ground plate 18 used in Embodiment 1 has three openings 18C disposed between the plate front end section 18D and the plate back end section 18E, the necessary strength can be ensured even if it is formed from a thin metal plate.

Embodiment 3

Figure 15:
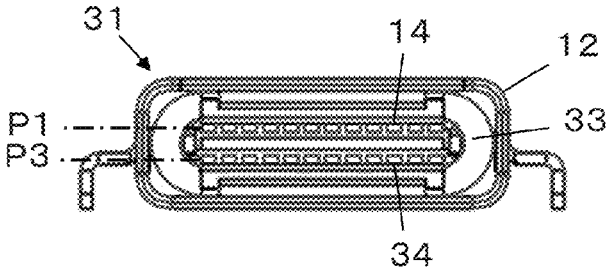
FIG. 15 is a front view illustrating a connector according to Embodiment 3.

FIG. 15 shows a connector 31 according to Embodiment 3. The connector 31 uses an insulator 33, instead of the insulator 13 in the connector 11 in Embodiment 1. The contacts 14 arranged on the contact array plane P1 and contacts 34 arranged on a contact array plane P3 are held by the insulator 33. The two contact array planes P1 and P3 are disposed parallel to each other, so that the contacts 14 and 34 are arranged in two rows of an upper row and a lower row, respectively.

Figure 16:
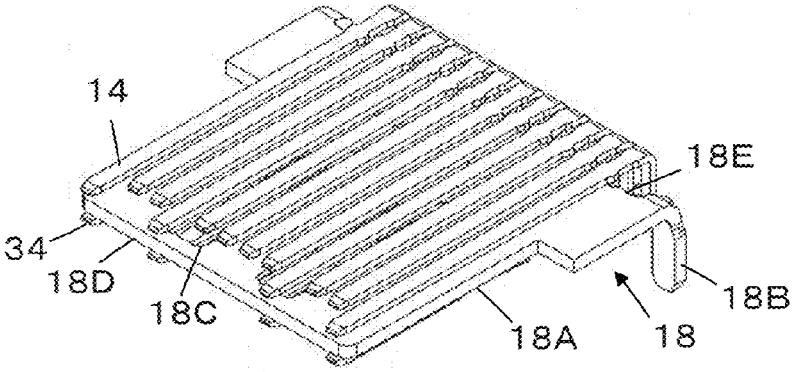
FIG. 16 is a perspective view illustrating contacts and a ground plate in the connector according to Embodiment 3.

In the insulator 33, the ground plate 18 used in Embodiment 1 is held. As shown in FIG. 16, the ground plate 18 is disposed adjacent to each of the contacts 14 and the contacts 34, and between the contacts 14 and the contacts 34.

Figure 17:
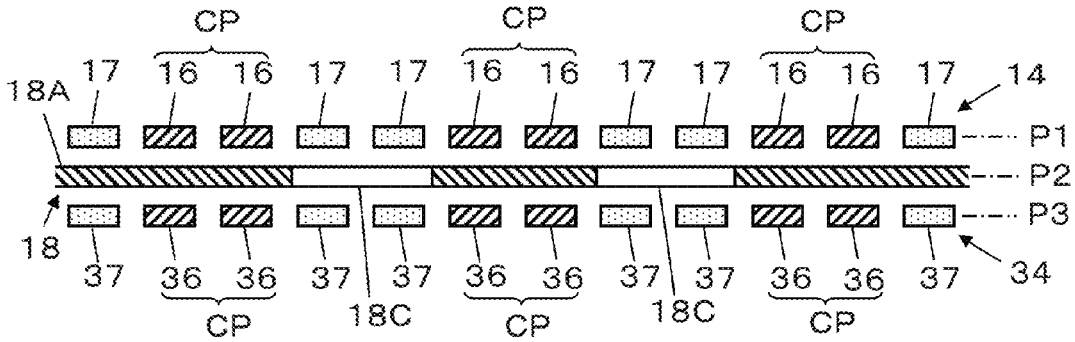
FIG. 17 is a partial front cross-sectional view illustrating a positional relationship between the contacts and the ground plate in the connector according to Embodiment 3.

As shown in FIG. 17, the contact array plane P1 and the contact array plane P3 are disposed at both sides of the ground plane P2 in which the plate body 18A of the ground plate 18 is disposed. The contacts 34 arranged on the contact array plane P3 are aligned symmetry to the alignment of the contacts 14 arranged on the contact array plane P1 with respect to the ground plane P2. That is, the contacts 34 can be divided in two: signal contacts 36 for signal transmission to and from a counter connector; and non-signal contacts 37 used for non-signal purposes such as power supply, ground connection, and detection of connector-fitting status. The signal contacts 36 are disposed at a location corresponding to the signal contacts 16 on the contact array plane P1, and the non-signal contacts 37 are disposed at a location corresponding to the non-signal contacts 17 on the contact array plane P1.

The differential signal contact pair CP is formed of the two signal contacts 36 adjacent to each other, and two non-signal contacts 37 are disposed between each differential signal contact pair CP and other differential signal contact pair CP.

Therefore, there are no openings 18C in the plate body 18A at a location facing the signal contacts 16 on the contact array plane P1, and the signal contacts 36 on the contact array plane P3. The openings 18C are located in the plate body 18A at a portion facing the non-signal contacts 17 disposed between the signal contacts 16 and the signal contacts 16 on the contact array plane P1, and the non-signal contacts 37 disposed between the signal contacts 36 and the signal contacts 36 on the contact array plane P3.

Figure 18:
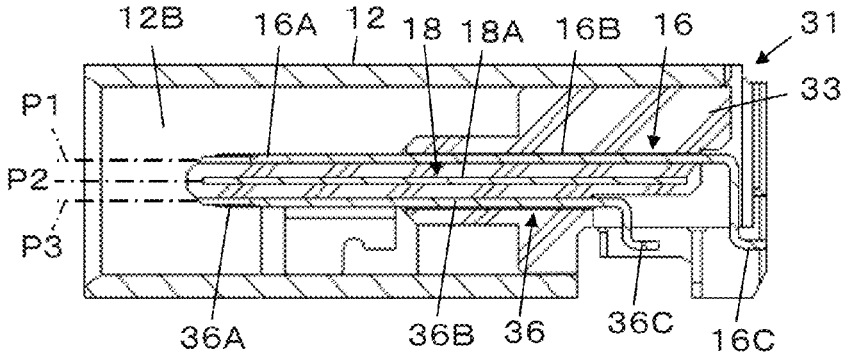
FIG. 18 is a cross-sectional view of the connector according to Embodiment 3, taken by cutting at a location of signal contacts.

FIG. 18 shows a cross-sectional view of the connector 31 taken by cutting at a location of the signal contacts 16 and 36. Each of the signal contacts 36 has, similar to the signal contacts 16, at a front end, a contact section 36A exposed to the counter connector housing section 12B, has in a middle portion, an insulator fixing section 36B to be fixed to the insulator 33, and has in a back end, a substrate mounting section 36C. The contact section 36A and the insulator fixing section 36B are extended flatly on the contact array plane P3. Then, the plate body 18A of the ground plate 18 faces the contact section 16A and the insulator fixing section 16B of the signal contacts 16, and the contact section 36A and the insulator fixing section 36B of the signal contacts 36.

Figure 19:
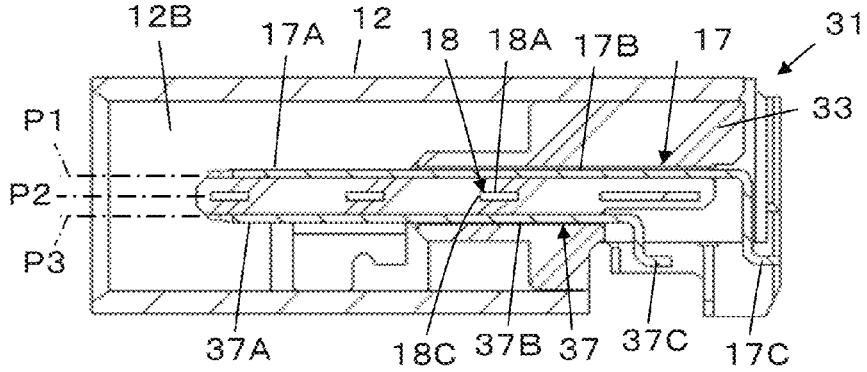
FIG. 19 is a cross-sectional view illustrating the connector according to Embodiment 3, taken by cutting at a location of non-signal contacts.

Also, FIG. 19 shows a cross-sectional view of the connector 31, taken by cutting at a location of the non-signal contacts 17 and 37. Each of the non-signal contacts 37 has, similar to the signal contacts 36, at a front end, a contact section 37A exposed to the counter connector housing section 12B, has in a middle portion, an insulator fixing section 37B fixed to the insulator 33, and has at a back end, a substrate mounting section 37C. The contact section 37A and the insulator fixing section 37B are extended flatly on the contact array plane P3. The plate body 18A of the ground plate 18 faces the contact section 17A and the insulator fixing section 17B of the non-signal contacts 17, and the contact section 37A and the insulator fixing section 37B of the non-signal contacts 37. In the plate body 18A of the ground plate 18, the openings 18C are formed at a location facing the non-signal contacts 17 and 37.

Figure 20:
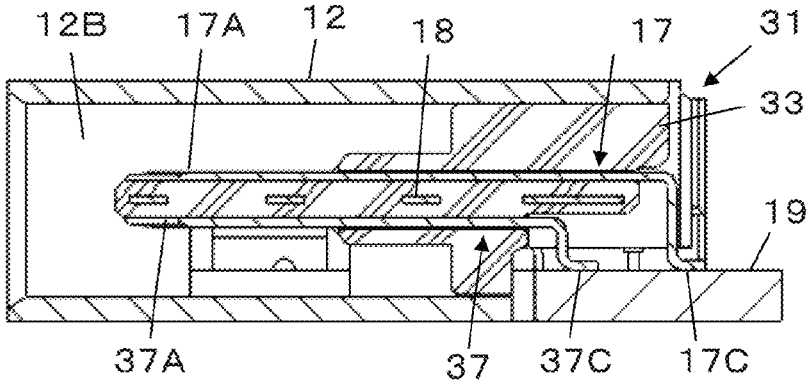
FIG. 20 is a cross-sectional view illustrating the connector according to Embodiment 3, as mounted on a substrate.

The connector 31 is mounted on the substrate 19, as shown in FIG. 20. The substrate mounting sections 16C of the signal contacts 16 and the substrate mounting sections 17C of the non-signal contacts 17, and the substrate mounting sections 36C of the signal contacts 36 and the substrate mounting sections 37C of the non-signal contacts 37 are mounted and fixed by soldering to corresponding connecting pads (not shown) on the substrate 19, respectively.

The counter connector is inserted into the counter connector housing section 12B of the metal shell 12, so that the contact sections 16A of the signal contacts 16 and the contact sections 17A of the non-signal contacts 17, and the contact sections 36A of the signal contacts 36 and the contact sections 37A of the non-signal contacts 37 are made to contact to the corresponding contacts of the counter connector, respectively, making the connector to be in fitting status, to allow power transmitting/receiving and signal transmission, and the like, to be performed to/from the external apparatuses.

At this time, as shown in FIG. 17, each differential signal contact pair CP consisting of two adjacent signal contacts 16 is encompassed by the non-signal contacts 17 disposed on the both sides of the signal contacts 16 on the contact array plane P1, and the plate body 18A of the ground plate 18, disposed on the ground plane P2. Similarly, each differential signal contact pair CP consisting of two adjacent signal contacts 36 is encompassed by the non-signal contacts 37 disposed on the both sides of the signal contacts 16 on the contact array plane P3, and the plate body 18A of the ground plate 18, disposed on the ground plane P2. Therefore, the occurrence of cross-talk between each differential signal contact pair CP and other differential signal contact pair CP can be suppressed.

Further, since the two non-signal contacts 17 or 37 are disposed between each differential signal contact pair CP and other differential signal contact pair CP, and the openings 18C are formed in the plate body 18A at a portion facing the non-signal contacts 17 or 37, the occurrence of cross-talk between each differential signal contact pair CP and other differential signal contact pair CP through the ground plate 18 can be prevented even if the arranging pitch of the contacts is reduced and high speed signal transmission is performed.

It should be noted that, also in Embodiment 3, the number of the non-signal contacts 17 or 37 to be disposed between each differential signal contact pair CP and other differential signal contact pair CP is not limited to two, but one or three or more non-signal contacts 17 or 37 may be disposed between each differential signal contact pair CP and other differential signal contact pair CP.

In addition, the signal contacts 16 and 36 are not limited to those constituting the differential signal contact pair CP. For example, one or more non-signal contacts 17 may be disposed between one signal contact 16 and other signal contact 16, and one or more non-signal contacts 37 may be disposed between one signal contact 36 and other signal contact 36, and the openings 18C may be formed in the plate body 18A of the ground plate 18, at a location facing the non-signal contacts 17 and 37, thereby, high speed signal transmission can be achieved through the signal contacts 16 and 36, while suppressing the occurrence of cross-talk.

While, in Embodiment 3 described above, the contacts 14 arranged on the contact array plane P1 and the contacts 34 arranged on the contact array plane P3 are disposed symmetrically to each other with respect to the ground plane P2, symmetrical arrangement is not necessarily required. However, preferably, the non-signal contacts 17 and 37 are disposed at a location facing the openings 18C on the plate body 18A of the ground plate 18, and there are no openings 18C at a location facing the signal contacts 16 and 36.

Also in Embodiment 3, similar to Embodiment 2, various ground plates 21-23 shown in FIGS. 13A-13C may be used.

Embodiment 4

Figure 21:
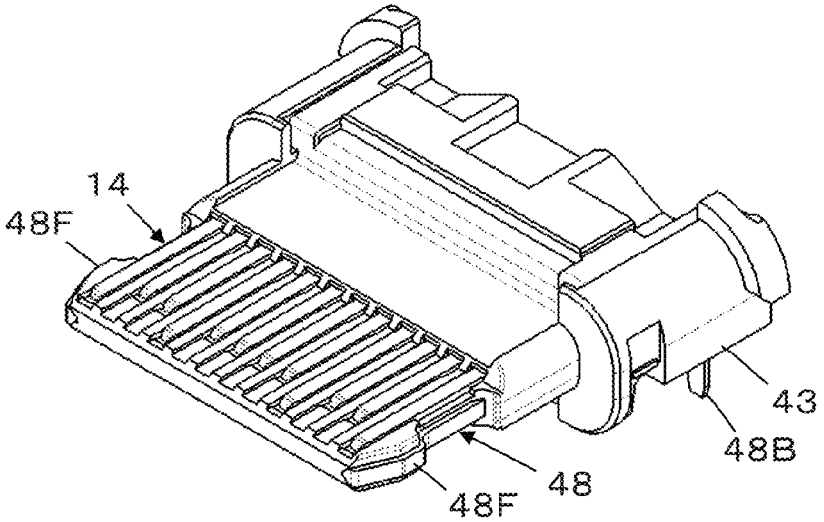
FIG. 21 is a perspective view illustrating a configuration of a connector according to Embodiment 4, in which a metal shell is eliminated.

FIG. 21 shows a configuration of a connector according to Embodiment 4, in which a metal shell is eliminated. This connector uses an insulator 43 and a ground plate 48 instead of the insulator 13 and the ground plate 18 used in the connector 11 in Embodiment 1, respectively. The contacts 14 and the ground plate 48 are held by the insulator 43.

Figure 22:
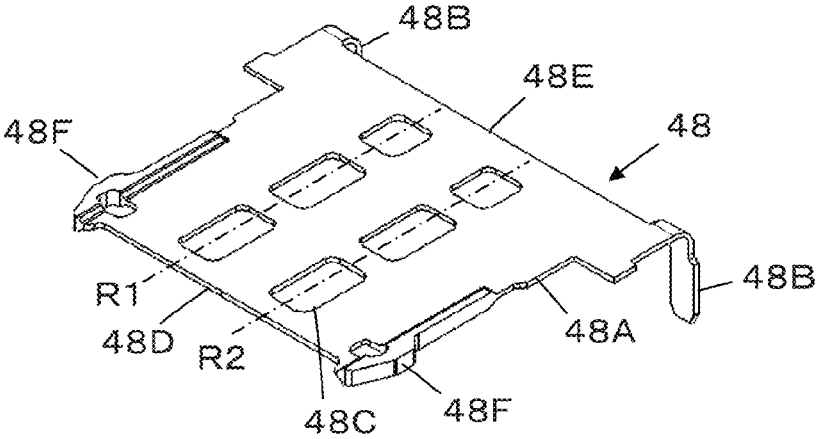
FIGS. 22 and 23 are a perspective view and a front view of a ground plate used in the connector according to Embodiment 4, respectively.

The ground plate 48 has an approximately rectangular shape, as shown in FIG. 22, similar to the ground plate 18 of the connector 11 in Embodiment 1. The ground plate 48 has an plate body 48A facing the contacts 14, and a pair of plate legs 48B protruding from both side sections of a plate back end section 48E, and bending perpendicularly with respect to the plate body 48A. Openings 48C are formed in the plate body 48A, arranged in two rows R1 and R2 extending from a plate front end section 48D to the plate back end section 48E.

Figure 23:
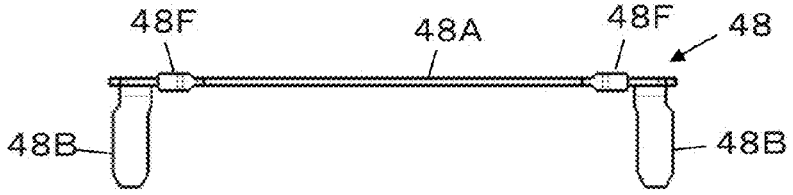

In addition, in the ground plate 48, a pair of lock receiving sections 48F is formed, protruding from the both side sections of the plate body 48A at the side of the plate front end section 48D, laterally, that is, protruding toward outside of the arranging direction of the contacts 14. These lock receiving sections 48F are adapted to catch the lock section of a counter connector when fitting into the counter connector, and are thicker than the plate body 48A, as shown in FIG. 23.

The plate body 48A is then embedded in the insulator 43, with the plate body 48A facing and close to the contacts 14. The ground plate 48 is held by the insulator 43 so that the pair of plate legs 48B and the pair of lock receiving sections 48F are exposed from the insulator 43. As shown in FIG. 21, the pair of plate legs 48B is exposed downwardly from the back end of the insulator 43. The pair of lock receiving sections 48F is exposed laterally from the both side sections of the front end of the insulator 43.

It should be noted that the openings 48C of the ground plate 48, similar to the openings 18C of the ground plate 18 in the connector 11 in Embodiment 1, are formed in a location facing the non-signal contacts 17 that are disposed between one signal contact 16 and other signal contact 16 among the contacts 14.

Figure 24:
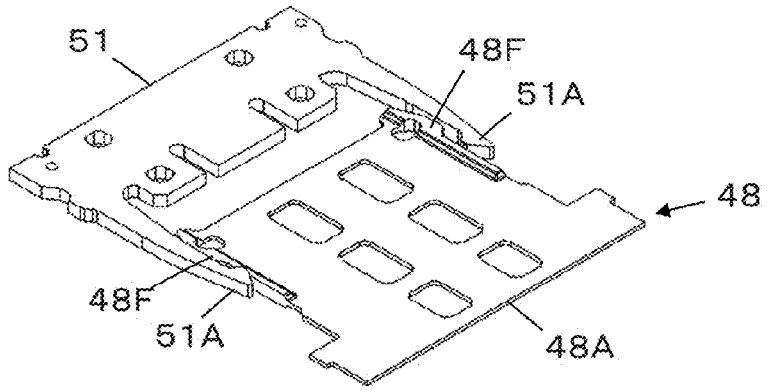
FIG. 24 is a perspective view, illustrating a behavior of a lock receiving section of the ground plate and a lock section of a counter connector, when the counter connector fits into the connector according to Embodiment 4.

As shown in FIG. 24, the counter connector to be fitted to the connector in Embodiment 4 has a lock member 51. A pair of lock sections 51A is formed protruding forwardly from the both side sections of the lock member 51. When the counter connector is fitted into the connector in Embodiment 4, the pair of lock sections 51A of the counter connector is made to contact with the pair of lock receiving sections 48F of the ground plate 48, so as to be deformed toward outside. The pair of deformed lock sections 51A of the counter connector is then latched by the lock receiving section 48F, after over-passing the lock receiving section 48F, so that the fitting status between the counter connector and the connector in Embodiment 4 can be maintained.

For a simplicity purpose, the pair of plate legs 48B of the ground plate 48 is not shown in FIG. 24.

In addition, by pulling the counter connector out of the connector in Embodiment 4, each lock section 51A is unlatched from the corresponding lock receiving section 48F to release the fitting status between the counter connector and the connector in Embodiment 4.

As described above, the lock receiving section 48F of the ground plate 48 has a thickness greater than the thickness of the plate body 48A.

High speed signal transmission can be achieved with high accuracy, regardless of the thickness of the plate body 48A, as long as the distance between the surface of the plate body 48A and the contacts 14 is kept to a certain necessary value, when disposing the plate body 48A. Therefore, by forming the plate body 48A to be thinner than the lock receiving section 48F, the size of the connector can be decreased.

On the other hand, the lock receiving section 48F may be formed to be thicker than the plate body 48A, so that a mechanical strength enough to catch the lock section 51A of the counter connector can be ensured. Also, when the thickness of the lock receiving section 48F is great enough, the latching between the lock receiving section 48F and the lock section 51A is ensured and fitting status can be maintained even if there is misalignment in a height direction with the lock section 51A of the counter connector. In addition, by forming the lock receiving section 48F to be thicker, the abrasion resistance of the lock receiving section 48F can be improved, and the stress concentration to the lock section 51A of the counter connector can be suppressed, and therefore, even if fitting and releasing operations are repeated to the counter connector, deterioration of the fitting retention performance caused by the lock section 51A can be prevented, thereby a longer life of the connector can be achieved.

Figure 25:
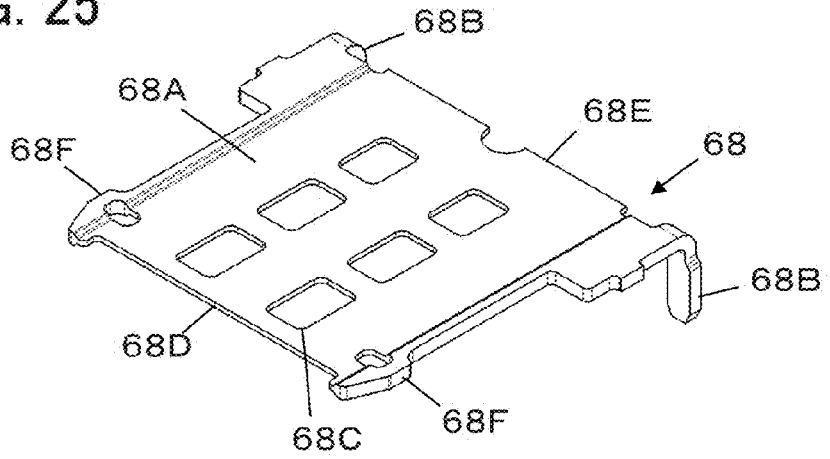
FIGS. 25 and 26 are a perspective view and a front view, illustrating a ground plate used in a connector according to a variation example of Embodiment 4, respectively.
Figure 26:
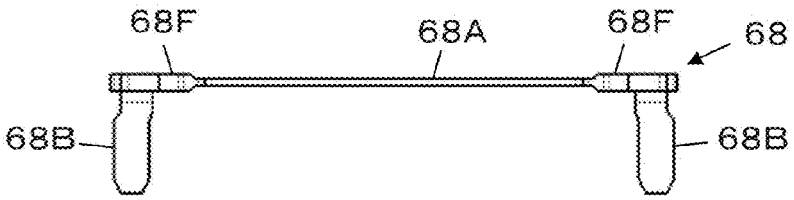

Instead of the ground plate 48 shown in FIG. 22, a ground plate 68 shown in FIGS. 25 and 26 may be used. In the ground plate 48, only the both side sections of the plate body 48A in the side of the plate front end section 48D have a thickness greater than the thickness of the plate body 48A, and at that location, the lock receiving section 48F is formed. In contrast, in the ground plate 68, a whole area in the both side sections of a plate body 68A from a plate front end section 68D to a plate back end section 68E, and a pair of plate legs 68B protruding from the both side sections of the plate back end section 68E have a thickness greater than the thickness of the plate body 68A, and lock receiving sections 68F are formed at the both side sections of the plate body 68A in the side of the plate front end section 68D.

That is, the central area of the plate body 68A in which openings 68C are disposed, is formed to be thin and other areas are formed to be thicker than the central area of the plate body 68A.

Even if such a ground plate 68 is used, the lock receiving sections 68F can catch the lock sections 51A of the counter connector and maintain fitting status with the counter connector.

It should be noted that while the ground plate 48 shown in FIG. 22 has three openings 48C between the plate front end section 48D and the plate back end section 48E, corresponding to the non-signal contacts 17 and the ground plate 68 shown in FIG. 25 also has three openings 68C between the plate front end section 68D and the plate back end section 68E, one opening 48C extending from the plate front end section 48D to the plate back end section 48E, or one opening 68C extending from the plate front end section 68D to the plate back end section 68E may be used as in Embodiment 2 shown in FIGS. 13A-13C.

In addition, the ground plate 48 shown in FIG. 22, or the ground plate 68 shown in FIG. 25 may also be used in a connector, such as the connector 31 in Embodiment 3, in which the contacts 14 and 34 are arranged in the pair of contact array planes P1 and P3 disposed at the both sides of the ground plane P2, respectively.

Figure 27:
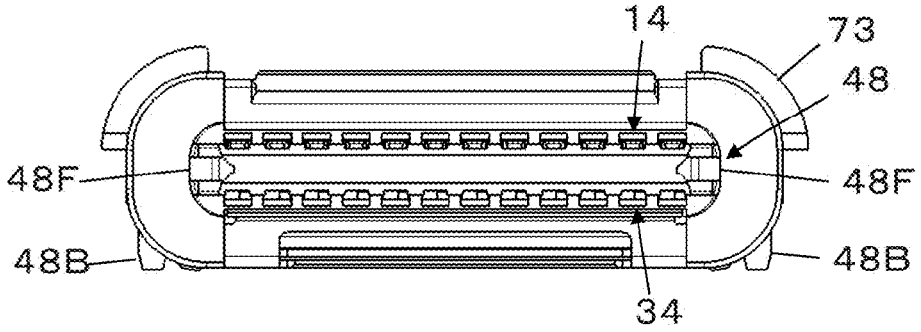
FIG. 27 is a front view, illustrating the connector according to other variation example of Embodiment 4, in which a metal shell is eliminated.
Figure 28:
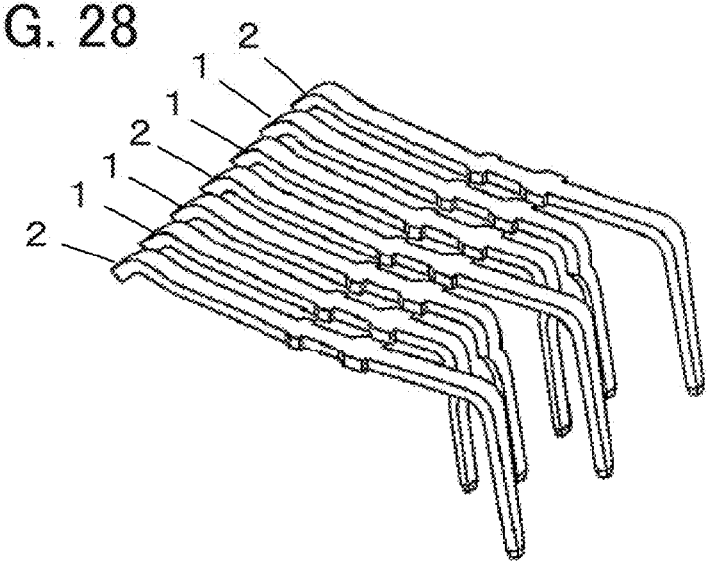
FIG. 28 is a perspective view, illustrating contacts in a prior art connector.
Figure 29:
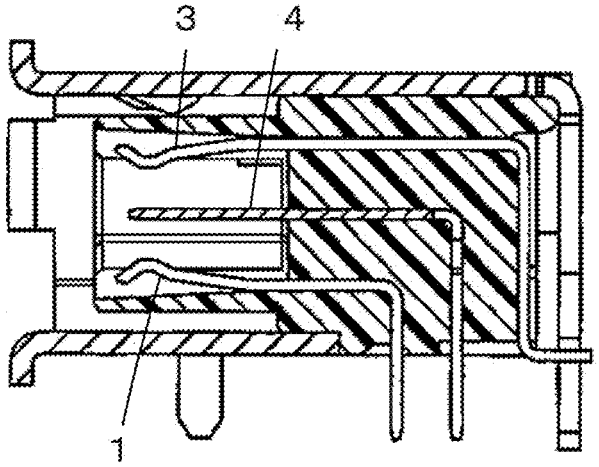
FIG. 29 is a cross-sectional view, illustrating a prior art connector.

For example, a configuration may be achieved, as shown in FIG. 27, in which the ground plate 48 and the contacts 14 and 34 are held by an insulator 73, the pair of plate legs 48B of the ground plate 48 is exposed to outside from the back end of the insulator 73 respectively, and the pair of lock receiving sections 48F protrudes laterally from the both side sections of the front end of the insulator 73 respectively so as to be exposed.

Even with such configuration, it is possible to maintain the fitting status to the counter connector by making the lock receiving sections 48F to catch the lock sections 51A of the counter connector.

What is claimed is:

1. A connector comprising:

a plurality of signal contacts and a plurality of non-signal contacts arranged on at least one contact array plane;

a ground plate disposed on a ground plane parallel to the contact array plane so as to face the plurality of signal contacts and the plurality of non-signal contacts; and an insulator which holds the plurality of signal contacts, the plurality of non-signal contacts and the ground plate, wherein at least one of the non-signal contacts is disposed between each of the signal contacts and other of the signal contacts, wherein the ground plate has at least one opening at a location facing the at least one of the non-signal contacts disposed between each of the signal contacts and other of the signal contacts, and wherein none of the signal contacts are disposed on the ground plane.

2. The connector according to claim 1, wherein two or more non-signal contacts out of the plurality of non-signal contacts are disposed between each of the signal contacts and other of the signal contacts.

3. The connector according to claim 1, wherein the plurality of signal contacts include at least one differential signal contact pair consisting of two contacts that transmit differential signals, and wherein the two contacts constituting the differential signal contact pair are disposed adjacent to each other with no non-signal contact disposed therebetween.

4. The connector according to claim 1, wherein the signal contacts and the non-signal contacts each has a contact section to be in contact with a contact of a counter connector at a front end thereof, a substrate mounting section to be mounted and fixed to a substrate at a back end thereof, and an insulator fixing section to be fixed to the insulator at a middle portion thereof, wherein the contact section and the insulator fixing section are formed on a same plane with each other, and wherein the ground plate faces the contact section and the insulator fixing section of the plurality of signal contacts and the plurality of non-signal contacts.

5. The connector according to claim 4, wherein the ground plate has a plate body facing the contact section and the insulator fixing section of the plurality of signal contacts and the plurality of non-signal contacts, and at least one plate leg section that is coupled to the plate body to be mounted and fixed on the substrate, and wherein the at least one opening is formed in the plate body.

6. The connector according to claim 5, wherein the at least one opening consists of a plurality of openings which are disposed correspondingly to the non-signal contacts disposed between each of the signal contacts and other of the signal contacts and disposed between a plate front end portion facing a front end of the contact section of each of the non-signal contacts and a plate back end portion facing a back end of the insulator fixing section of each of the non-signal contacts at a side of the substrate mounting section.

7. The connector according to claim 5, wherein the at least one opening consists of an opening which is disposed correspondingly to the non-signal contacts disposed between each of the signal contacts and other of the signal contacts and extends between a plate front end portion facing a front end of the contact section of each of the non-signal contacts and a plate back end portion facing a back end of the insulator fixing section of each of the non-signal contacts at a side of the substrate mounting section.

8. The connector according to claim 7, wherein the plate front end portion corresponding to the non-signal contact disposed between each of the signal contacts and other of the signal contacts is notched so as to open a front end of the opening.

9. The connector according to claim 7, wherein the plate front end portion and the plate back end portion corresponding to the non-signal contact disposed between each of the signal contacts and other of the signal contacts are notched so as to open a front end and a back end of the opening.

10. The connector according to claim 1, wherein the ground plate has a lock receiving section which protrudes outward from a location facing the plurality of signal contacts and the plurality of non-signal contacts in an arrangement direction of the plurality of signal contacts and the plurality of non-signal contacts so as to be exposed outside of the insulator and catches a lock section of a counter connector when fitting to the counter connector.

11. The connector according to claim 10, wherein the lock receiving section has a thickness greater than a thickness of the ground plate at a portion facing the plurality of signal contacts and the plurality of non-signal contacts.

12. The connector according to claim 1, wherein the at least one contact array plane consists of a pair of contact array planes formed on both sides of the ground plane, the plurality of signal contacts and the plurality of non-signal contacts being arranged on each of the pair of contact array planes.

13. The connector according to claim 12, wherein the plurality of signal contacts and the plurality of non-signal contacts arranged on the pair of the contact array planes are disposed symmetrically with respect to the ground plane.

14. The connector according to claim 1, wherein the plurality of non-signal contacts include at least one of a power supply contact, a ground contact, and a contact for detecting connector-fitting status.

15. The connector according to claim 1, wherein the plurality of signal contacts, the plurality of non-signal contacts, and the ground plate are insert-molded with a resin used to form the insulator.

16. The connector according to claim 1, further comprising a metal shell adapted to cover an outer periphery portion of the insulator.

* * * * *